United States Patent [19]

Perkins

[11] Patent Number: 4,532,990

[45] Date of Patent: Aug. 6, 1985

[54] ISOLATION OF AN ELECTRICAL POWER TRANSMISSION WELL

[75] Inventor: Thomas K. Perkins, Dallas, Tex.

[73] Assignee: Atlantic Richfield Co., Los Angeles, Calif.

[21] Appl. No.: 510,034

[22] Filed: Jul. 1, 1983

[51] Int. Cl.[3] ..... E21B 43/25

[52] U.S. Cl. ..... 166/248; 166/302; 166/66.4

[58] Field of Search ..... 166/248, 302, 369, 65 R; 174/47, 138 R; 138/42; 418/206, 152

[56] References Cited

U.S. PATENT DOCUMENTS

| | | | |
|---|---|---|---|
| 2,178,931 | 11/1939 | Crites et al. | 174/47 |
| 2,547,440 | 4/1951 | Clark et al. | 174/8 |
| 2,611,323 | 9/1952 | Digney | 418/152 |
| 2,965,040 | 12/1960 | Eisenberg | 418/152 |
| 2,966,860 | 1/1961 | Maynard | 418/152 |
| 3,105,446 | 10/1963 | Blomgren, Sr. et al. | 418/152 |
| 3,400,055 | 9/1968 | Messner | 174/9 F |
| 3,459,337 | 8/1969 | Williamson | 418/152 |
| 3,831,906 | 8/1974 | Wakeman | 418/206 |
| 3,866,678 | 2/1975 | Jeter | 174/47 |
| 3,987,809 | 10/1976 | Baumann | 138/42 |

*Primary Examiner*—Stephen J. Novosad
*Assistant Examiner*—M. Goodwin
*Attorney, Agent, or Firm*—M. David Folzenlogen

[57] ABSTRACT

In processes using electrical power to apply heat to a subsurface formation through a transmission well, power losses are reduced by installing in flowlines leading to the well one or more devices that electrically disrupts the flowline and that creates a tortuous flow path for liquids flowing through the device. The parts of the device contacting liquids are either fabricated of metal which is electrically insulated from the liquids or are fabricated of electrically nonconductive material. The device may be a free-wheeling hydraulic pump or motor, for example, a free-wheeling gear pump.

8 Claims, 2 Drawing Figures

ISOLATION OF AN ELECTRICAL POWER TRANSMISSION WELL

BACKGROUND OF THE INVENTION

This invention pertains to the prevention of electrical power losses from an electrical power transmission well. More particularly, a high voltage well which is used to either produce or inject salt water is isolated by insulating couplings and an insulated tortuous salt water path.

Large deposits of viscous hydrocarbonaceous substances, such as for example the Ugnu formation in Alaska, are known to exist in subterranean formations. Many techniques have been proposed for producing tar sands and viscous oils. Relatively recently, it has been proposed, for example, in U.S. Pat. Nos. 3,642,066; 3,874,450; 3,848,671; 3,948,319; 3,958,636; 4,010,799 and 4,084,637 to use electrical current to add heat to a subsurface pay zone containing tar sands or viscous oil to render the viscous hydrocarbon more flowable. The oil components flow to a producing well where the oil is produced. The produced fluids may contain high salt content formation waters of low electrical resistance. Sometimes low resistance salt water is also injected through injection wells to maintain formation pressure and drive oil into the producing wells. Both the production wells and the injection wells may be used as power transmission wells. Both types of wells may frequently be connected through flowlines to grounded metal equipment, for example, a salt water disposal or producing well. In Alaska, for example, a water injection well may be connected to a flowline which is connected to a sea water pump which is grounded in the sea or ocean. When electrical power is applied to a well producing or injecting salt water, electrical currents are lost through the flowlines to the grounded metal equipment. This power loss decreases the efficiency of the electrical heating process. Disrupting the metal flowline path with insulating flanges, for example, does not sufficiently alleviate the problem of such power loss. Power transmission wells for subsurface heating use voltages of up to several thousand volts and the low resistance salt water in the flowline form an alternate electrical path that is low enough in resistance to still cause undesirably high power or current losses.

It is the primary purpose of this invention to provide a system for isolating an electrical power transmission well from other grounded metal equipment and thereby decrease power losses to such equipment.

SUMMARY OF THE INVENTION

The present invention pertains to an electrical power transmission well that is connected to a flowline that is grounded and contains flowing salt water. The flowline itself may be grounded, or the flowline may be connected to other equipment that is grounded. In this invention, the transmission well is electrically isolated from the grounded flowline or other equipment by creating a tortuous electrical path through the salt water in an electrically isolated and insulated segment of the flowline. More particularly, in one embodiment of this invention, a free-wheeling device similar to a hydraulic pump or motor, for example, a free-wheeling gear pump, is placed in the flowline near the transmission well. The motor cavity and the rotors, vanes, or gears are either fabricated of electrically nonconductive material or they are fabricated of metal and are coated with electrical insulation. If the device is fabricated of metal, it will be isolated electrically at each end by electrical insulating flanges or couplings. Because the salt water must follow a tortuous path through the device, electrical resistance of the tortuous brine path will be relatively high and thereby reduce power losses through the flowline and device to an acceptable level. One or more such flow deflecting devices may be placed in series in the same flow path to increase the effective resistance.

DESCRIPTION OF PREFERRED EMBODIMENTS

Figure 1:
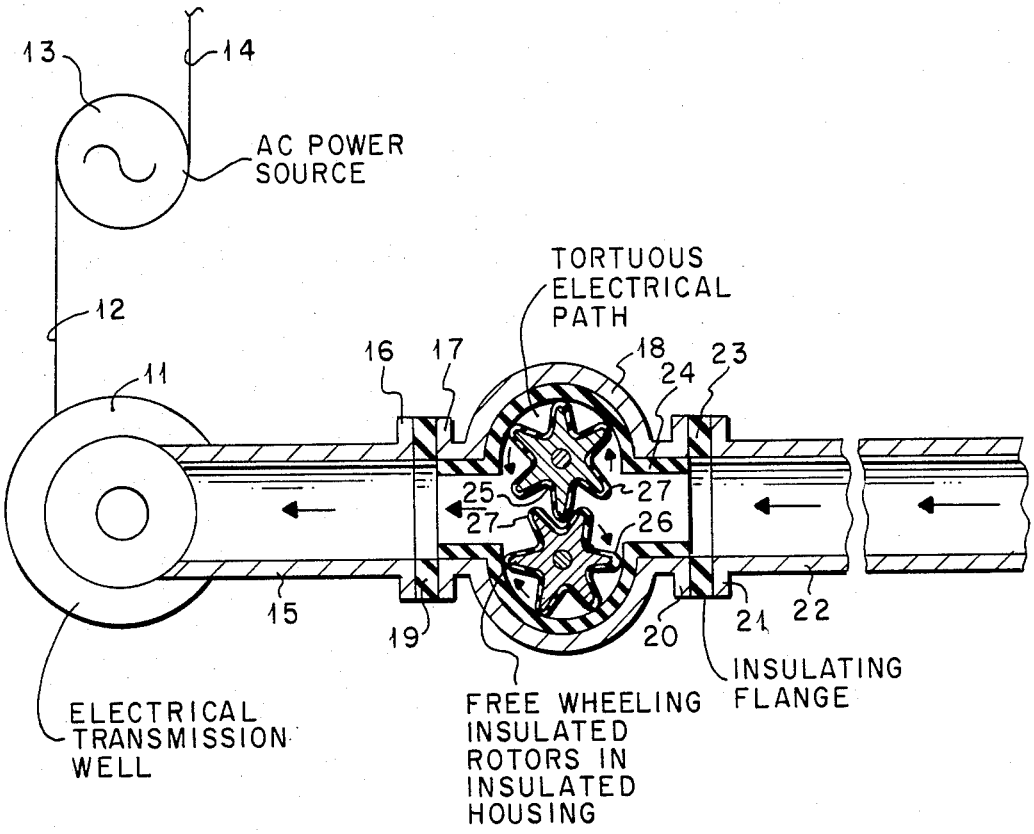
FIG. 1 is a top view, partly schematic and partly in section, illustrating an electrically isolated power transmission well.

This invention pertains to processes that transmit alternating current through a well into a subsurface formation in order that current may flow between the well and another well or electrode through the formation and thereby apply heat to the formation. The well is either a producing well or an injection well. The well is connected to a flowline through which salt water is flowed. The salt water may be being produced from the formation. In this case, the salt water will be flowing away from the well to grounded disposal or production equipment including the flowline itself. The salt water may be being injected into the formation. In this case, the salt water will be flowing into the well from grounded water production or pumping equipment, such as, for example, the flowline itself or a sea water pumping system. All or a part of metal parts of the well is at relatively high voltage. The metal parts at high voltage are in electrical contact with the salt water even if the wellhead is electrically insulated. Unless the grounded other equipment is sufficiently isolated electrically from the grounded other equipment, electrical power will flow in undesirable amounts through the flowline or salt water to the grounded other equipment, thereby reducing the efficiency of the electric heating process. The object of this invention is to provide greater electrical isolation of an electrical transmission well.

Accordingly, shown in the drawing is high voltage transmission well 11 which for simplicity is shown directly connected via conductor 12 to alternating current power source 13. The power source is also connected via conductor 14 to another electrode or well (not shown).

Connected to the well and in fluid communication with one or more tubular strings in the well is outlet flowline 15 which for illustration purposes is shown with flange end 16. The flange is connected to outlet end 17 of housing 18. Between the flanges is outlet insulating means 19 which is adapted to prevent electrical contact between housing 18 and outlet flowline 15. Inlet end 20 of the housing is shown connected to flange 21 on inlet flowline 22. Between the flanges is inlet insulating means 23 which is adapted to prevent electrical contact between housing 18 and the inlet flowline. Any sort of known insulating means may be used, such as for example, insulating flange gaskets and bolt isolators, insulating couplings or other similar insulating connectors.

The housing is adapted to conduct liquids from inlet flowline 22 to outlet flowline 15. The interior surface of housing 18 is covered with insulation 24 which electrically insulates the housing from liquids flowing to the housing. Inside the housing is a flow deflecting means which is adapted to cause liquid flow through the housing to follow a tortuous path. The flow deflecting means are insulated from electrical contact with liquids flowing through the housing. Any sort of known liquid deflecting means may be used, such as for example, staggered baffles, plates with staggered holes, vanes, fins, and other similar standard deflecting devices. A preferred deflecting means is a set of two free-wheeling intermeshing gear-like members 25 and 26 which are adapted to rotate inside housing 18 when liquid is flowed through the housing. The gear-like members are made free-wheeling so that the gear-like members do not interfere with adequate liquid flow through the housing.

Figure 2:
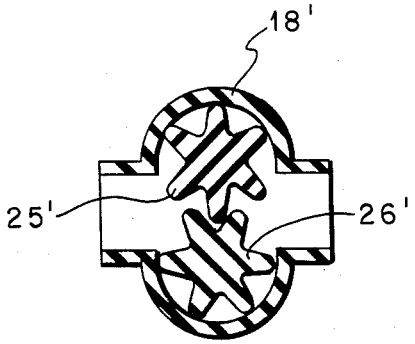
FIG. 2 is a sectional top view of an electrically nonconductive device for isolation of a transmission well.

In FIG. 2, insulating means 19 and 23 and insulation 24 are not required because housing 18' is fabricated of electrically nonconductive material, such as for example, fiberglass, bakelite, rubber-like material, plastic or other nonconductive material. Similarily, gear-like members 25' and 26' are made of electrically nonconductive material.

In operation, as alternating current power is applied to well 11 from power source 13, salt water is flowed either to or from the well. For illustrative purposes, well 11 is shown as an injection well and the salt or sea water is flowed into the well where it is conducted to subsurface formation. When the water flows through housing 18 it causes free-wheeling gear-like members 25 and 26 to rotate. The two meshed gears are specially fitted in the housing so that the spaces between the gear teeth and housing do not allow the liquid to slip directly from inlet to outlet. The liquid, therefore, needs to rotate the gears and follow a sort of pulsating tortuous path through the housing. This tortuous path increases the effective electrical resistance of the salt or sea water, thereby reducing power loss from the well through the salt water to ground other equipment. If the effective increase in resistance is not sufficient, more than one housing may be used in series in the same liquid flow path.

From the foregoing, it can be seen that this invention provides an improved system for isolating an electrical power transmission well from grounded other metal equipment used in conjunction with the well. This thereby decreases power losses to such equipment.

This invention has been described using a simplified drawing. It is understood that numerous known changes in details may be applied without departing from the spirit and scope of the claims. For example, the isolating device may be installed in several flowlines or at any appropriate spot in the flowline.

What is claimed is:

1. In a system wherein a well is used to transmit alternating current power into a subsurface formation containing viscous hydrocarbons to heat said formation, an apparatus for reducing power losses comprising housing means having an inlet end and an outlet end, said housing means being adapted to conduct liquids from an inlet flowline to an outlet flowline, flow deflecting means adapted to cause liquid flow through said housing to follow a tortuous path, said housing means and said flow deflecting means being electrically insulated from said liquid, inlet insulating means adapted to prevent electrical contact between said housing and said inlet flowline when said housing is installed on said inlet flowline, and outlet insulating means adapted to prevent electrical contact between housing and said outlet flowline when said housing is installed on said outlet flowline.

2. The apparatus of claim 1 wherein said housing is installed between said inlet and outlet flowlines and one of said flowlines is connected to and fluidly communicates with a well and said well is connected to an alternating current power source.

3. The apparatus of claim 2 wherein more than one housing means and flow deflecting means are installed in series in the same liquid flow path.

4. The apparatus of claim 1 wherein the flow deflecting means is comprised of two free-wheeling intermeshing gear-like members which are adapted to rotate inside said housing when liquid is flowed through said housing.

5. The apparatus of claim 4 wherein said housing is installed between said inlet and outlet flowlines and one of said flowlines is connected to and fluidly communicates with a well and said well is connected to an alternating current power source.

6. The apparatus of claim 5 wherein more than one housing means and flow deflecting means are installed in series in the same liquid flow path.

7. In a system wherein a well is used to transmit alternating current power into a subsurface formation, a method for heating a subsurface formation containing viscous hydrocarbons and for reducing power losses comprising:

(a) connecting an inlet end of an internally electrically insulated housing and flow deflecting means to an inlet flowline;

(b) connecting an outlet end of said electrically insulated housing and flow deflecting means to an outlet flowline, said housing and flow deflecting means being adapted to conduct liquids from said inlet flowline to said outlet flowline and to cause said liquid to follow a tortuous path through said housing and flow deflecting means;

(c) installing inlet insulating means between said inlet flowline and said inlet end of said housing and flow deflecting means, said inlet insulating means being adapted to prevent electrical contact between said inlet flowline and said housing and flow deflecting means;

(d) installing outlet insulating means between said outlet flowline and said outlet end of said housing and flow deflecting means, said outlet insulating means being adapted to prevent electrical contact between said outlet flowline and said housing and flow deflecting means;

(e) connecting one of said flowlines to said well;

(f) flowing salt water through said inlet and outlet flowlines and in a tortuous path through said housing and flow deflecting means; and, (g) simultaneously with step "(f)", applying alternating current electrical voltage to said well to add heat to said formation.

8. In the method of claim 7 wherein the method includes:

(h) connecting an inlet end of an internally electrically insulated second housing and flow deflecting means to a first segment of one of said flowlines;

(i) connecting an outlet end of said electrically insulated second housing and flow deflecting means to a second segment of said flowlines, said second housing and flow deflecting means being adapted to conduct liquids from said first segment to said second segment of said flowline and to cause said liquid to follow a tortuous path through said second housing and flow deflecting means;

(j) installing second inlet insulating means between said first segment of said flowline and said inlet end of said second housing and flow deflecting means, said second inlet insulating means being adapted to prevent electrical contact between said first segment of said flowline and said second housing and flow deflecting means;

(k) installing second outlet insulating means between said second segment of said flowline and said outlet end of said second housing and flow deflecting means, said second outlet insulating means being adapted to prevent electrical contact between said second segment of said flowline and said second housing and flow deflecting means; and, (l) in step "(f)", flowing salt water through said inlet and outlet flowlines and said first and second segments and in a tortuous path through said first and second housing and flow deflecting means.

* * * * *